US010401041B2

(12) United States Patent
Martinez Galvan

(10) Patent No.: US 10,401,041 B2
(45) Date of Patent: Sep. 3, 2019

(54) PORTABLE AIR CONDITIONER

(71) Applicant: Electrolux Appliances Aktiebolag, Stockholm (SE)

(72) Inventor: Israel Martinez Galvan, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 0 days.

(21) Appl. No.: 15/759,421

(22) PCT Filed: Aug. 30, 2016

(86) PCT No.: PCT/EP2016/070382

§ 371 (c)(1),
(2) Date: Mar. 12, 2018

(87) PCT Pub. No.: WO2017/045909

PCT Pub. Date: Mar. 23, 2017

(65) Prior Publication Data

US 2018/0266705 A1 Sep. 20, 2018

(30) Foreign Application Priority Data

Sep. 18, 2015 (SE) ..... 1551203

(51) Int. Cl.

| | |
|---|---|
| ***F24F 1/04*** | (2011.01) |
| ***F24F 1/022*** | (2019.01) |
| ***F24F 13/06*** | (2006.01) |
| ***F24F 13/08*** | (2006.01) |

(52) U.S. Cl.

CPC ..... *F24F 1/04* (2013.01); *F24F 1/022* (2013.01); *F24F 13/06* (2013.01); *F24F 13/081* (2013.01)

(58) Field of Classification Search

CPC ..... F25F 1/025; F25F 13/06; F25F 13/081; F25F 1/04

See application file for complete search history.

(56) References Cited

U.S. PATENT DOCUMENTS 2,234,753 A 3/1941 Frazer
4,086,886 A * 5/1978 Edmaier ..... F01P 3/18 123/41.49

(Continued)

FOREIGN PATENT DOCUMENTS

EP 0756140 A2 1/1997
FR 755472 A 11/1933

(Continued)

OTHER PUBLICATIONS

International Search Report and Written Opinion for International Application No. PCT/EP2016/070382, dated Dec. 1, 2016, 14 pages.

*Primary Examiner* — Elizabeth J Martin
(74) *Attorney, Agent, or Firm* — RatnerPrestia

(57) ABSTRACT

A portable air-conditioner includes a compressor, a condenser, and an evaporator located inside a housing. The air-conditioner further includes an element, such as an electronic box, located in the air-flow path inside the portable air-conditioner between the evaporator to an axial fan. The element can be wider at its lower section than at its upper section to enhance an upwards air-flow in the air conditioner.

21 Claims, 7 Drawing Sheets

(56) References Cited

U.S. PATENT DOCUMENTS

| | | | | |
|---|---|---|---|---|
| 4,203,302 | A * | 5/1980 | Lapeyre | F24F 1/027<br>62/259.3 |
| 2013/0327509 | A1* | 12/2013 | Michitsuji | F24F 13/30<br>165/172 |
| 2015/0211802 | A1* | 7/2015 | Yokozeki | F28F 9/0275<br>165/104.14 |
| 2016/0097547 | A1* | 4/2016 | Selg | F24F 13/20<br>62/293 |

FOREIGN PATENT DOCUMENTS

| | | | |
|---|---|---|---|
| WO | 2005054751 | A2 | 6/2005 |
| WO | 2005116530 | A1 | 12/2005 |
| WO | 2014206846 | A1 | 12/2014 |

* cited by examiner

PORTABLE AIR CONDITIONER

This application is a U.S. National Phase application of PCT International Application No. PCT/EP2016/070382, filed Aug. 30, 2016, which claims the benefit of Swedish Patent Application No. 1551203-1, filed Sep. 18, 2015, both of which are incorporated by reference herein.

TECHNICAL FIELD

The present disclosure relates to an air-conditioner. In particular the present disclosure relates to a portable air-conditioner.

BACKGROUND

Air conditioning (AC) is a collective expression for conditioning air into a desired state. It could be heating the air during cold periods, cooling the air during warmer periods or for cleaning the air if it contains unwanted particles. However, the expression air conditioning is most often used when emphasizing cooling. As a product, air conditioners can look and be used in various ways, but they all share the same basic technology.

Existing portable air-conditioners are often found to be large, hard to handle, noisy and inefficient. Furthermore, the connected exhaust air outlet that removes the heat from the room is often complicated and inefficient in its design. A known portable air-conditioner is for example described in the U.S. Pat. No. 2,234,753.

The design of portable AC systems differs from other Air Conditioners because all the components of the system are mounted inside of a packed unit which has to work inside of the conditioned space, releasing the residual energy (generated in the normal cooling process) through an air exhaust system which is usually connected to the outside.

In portable AC units there are two general procedures to cool down an air source condenser: single duct and dual duct methods. In the first one (single duct), the system takes air from its surroundings (conditioned space), forcing it to pass through the condenser surface and eventually removing the residual energy from it. Then, the hot air is expelled outdoors by using a single duct system. In this method, the intake air temperature has the indoor temperature conditions, which makes the energy exchange process more beneficial from standpoint of the refrigerant cycle.

In the dual duct method, the system uses an air intake duct to inject "hot" air from outdoor to cool down the condenser. Eventually the air coming from condenser at a relatively high temperature is released outdoors again by a secondary exhaust duct. In this method the air intake temperature is at the outdoor temperature conditions. This method can provide a quicker cooling effect for the user, since the system is not using the indoor air as a coolant media for condenser, but requiring in turn a larger size/volume of components to compensate the higher inlet outdoor temperatures.

Both methods, single and dual duct, have different limitations in terms of: air flow rates, size of the heat exchangers and also dimensions of the air piping system.

Those particularities requires that the portable AC systems make use of particular size of condensers, limiting the maximum air flow rate used by the system, since the air intake and air exhaust systems have to be as compact as possible.

Air flow rates in portable AC systems are also limited by the noise levels, since larger air flow rates flowing through small diameter hoses lead to higher pressure drops and higher noise levels. In that sense, the single duct systems have a clear advantage over the dual duct systems, because the temperature difference between the intake air and the condensing temperature of the cycle is larger, requiring lower air flow rates to perform the heat rejection process.

So, for portable AC systems, the condenser is one of the most critical components to design, since it has to exchange higher heat loads with a very limited air flow rate. Therefore, that particularity affects in a significant way the whole design of the condenser and the whole system performance.

On the other hand, evaporator is also an essential component to consider carefully in the design of portable AC systems, since this component has also similar limitations in terms of air flows and noise than air source condenser.

Additionally, the evaporator and its fan are the components of the system that interact directly with the conditioned space, since it is through those components that the system provides the cooling capacity to the indoors area. The importance of a good design of the evaporator lays in get the proper temperature distribution, humidity levels and air flow that in turn will affect the well-being and comfort of the users of the system.

For those reasons, the proper design of heat exchangers plays then an important role in the system performance. An optimum design of the heat exchanger geometries (internal and external), like the number of refrigeration circuits, the pipe connections and the heat exchanger size will affect the heat transfer processes and pressure drops, which will be critical for getting the optimum performance of the combined system.

There is a constant desire to improve the operation of air-conditioners.

Hence, there is a need for an improved air-conditioner.

SUMMARY

It is an object of the present invention to provide an improved air-conditioner that at least partly solves problems with existing air-conditioners.

This object and others are obtained by the air conditioner as set out in the appended claims. Also disclosed are devices that can be used in an air-conditioner, in particular portable air-conditioners having a generally cylindrical shape. In particular the air-conditioner can be symmetrical around a vertical axis such that the outside vertical side of the air-conditioner has a generally circular shape as seen from above.

In accordance with a first aspect a portable air-conditioner is provided. The air-conditioner comprises a compressor, a condenser, and an evaporator located inside a housing. The air conditioner further comprises a cool air outlet and a warm air outlet. The portable air-conditioner further comprises an element located in the air-flow path inside the portable air-conditioner from the evaporator to an axial fan of the portable air-conditioner. The element can be wider at its lower section than in its upper section. Such an element will enhance the up wards air-flow in the air-conditioner.

In accordance with one embodiment the element is generally conical. The element can be adapted to house an electronic box or a control box or other electric circuits. Hereby, the electronic box can be efficiently placed in the cool air stream output from the air-conditioner and at the same time provide an efficient air-stream within the air-conditioner.

In accordance with a second aspect a portable air-conditioner is provided. The air-conditioner comprises a compressor, a condenser, and an evaporator located inside a housing.

The air conditioner further comprises a cool air outlet and a warm air outlet. The portable air-conditioner comprises at its top section an air diffuser made up by two different elements adapted to provide an air outflow in both an upwards and a lateral direction.

In accordance with one embodiment the portable air-conditioner can comprise an element that is ring shaped and encloses the outside of fan blades of the evaporator.

In accordance with one embodiment an element is provided that is adapted to allow an upward air stream and adapted to direct at some of the upward air-stream in direction deviating from the upward direction of the upward air-stream. The element can be configured to direct all of the upward air-stream in direction deviating from the direction of the upward air-stream.

In accordance with a third aspect a portable air-conditioner is provided. The air-conditioner comprises a compressor, a condenser, and an evaporator located inside a housing. The air conditioner further comprises a cool air outlet and a warm air outlet. The portable air-conditioner comprises a three row cylindrical condenser. The condenser can have two passes in the two inner rows of said three rows and one common pass in the outer row of said three rows.

In accordance with one embodiment the condenser has 8 or 12 pipes per row. In accordance with one embodiment the pipes have a diameter between 5-6 mm.

In accordance with one embodiment the condenser is provided with fins having circular or elliptical holes.

In accordance with a forth aspect a portable air-conditioner is provided. The air-conditioner comprises a compressor, a condenser, and an evaporator located inside a housing. The air conditioner further comprises a cool air outlet and a warm air outlet. The portable air-conditioner comprises a condenser radial fan. The radial fan has a housing with sealing elements provided inside the housing.

In accordance with one embodiment the sealing elements are provided to reduce the clearance distance between the radial fan and the housing.

BRIEF DESCRIPTION OF THE DRAWINGS

The present invention will now be described in more detail by way of non-limiting examples and with reference to the accompanying drawings, in which.

DETAILED DESCRIPTION

The below disclosure relates generally to air-conditioners. The described embodiments are particularly useful for portable air-conditioners and can for example be used in portable air-conditioners having a generally cylindrical shape. Below some exemplary embodiments of the internal layouts of the components of portable Air-Conditioner (AC) units, particularly designs using cylindrical heat exchangers.

Also described are exemplary distributions of components in the system to improve performance of the AC unit in terms of air distribution, pressure drop in the refrigerant and in the air circuits, and also the better performance from a thermal point of view.

Further different solutions to improve the performance of cylindrical heat exchangers are described. Such improved implementations include geometry details like: optimum pipe connections, optimum number of rows, pipes per row, fins arrangements, diameters, etc.

Some other improvements related with the air distribution and radial fan design are also described herein.

In the following a layout and components distribution in a portable AC unit with a cylindrical shape is described. It is to be understood that the different locations for all described components can be applied in any suitable configuration. Hence, it is not necessary to combine all the features described in the different embodiments. Rather the described embodiments set out a possible configuration and some locations/components can be moved or replaced with other components.

Below the relative position of the internal components of a portable Air Conditioner are set out in some different exemplary embodiments. The layout of the components here proposed provides improved system performance from the standpoint of the air flow and thermal cycle.

Figure 1:
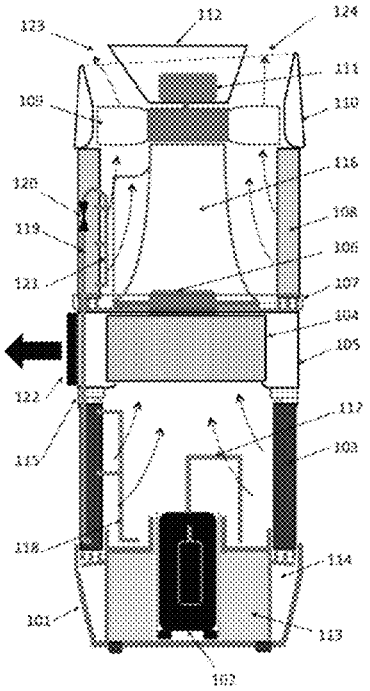
FIG. 1 shows an embodiment of some components and their relative position in a portable air-conditioner.

FIG. 1 shows an embodiment of some components and their relative position in a portable air-conditioner also termed AC unit below. In FIG. 1, 101 represents a base of the AC unit, 102 is a compressor, 103 is a cylindrical condenser, 104 is a condenser radial fan, 105 is a radial fan housing, 106 is a radial fan motor, 107 is an evaporator base, 108 is a cylindrical evaporator, 109 is an evaporator axial fan, 110 is an external ring of the evaporator air diffuser, 111 is an axial fan motor, 112 is a central element of the evaporator air diffuser which include two main outlet directions (angular and upwards), 113 represents a noise proof material around compressor, 114 is a water tank in the base of the system, 115 is a dripping water system to remove condensate, 116 is an electronic/control box, 117 is a refrigerant discharge pipe, 118 is a condenser inlet pipe, 119 is a refrigerant liquid line, 120 is an expansion device, 121 is an evaporator inlet port, 122 is a hot air exhaust that is connectable to a hose, 123 is a top air exhaust with an angular direction, 124 is a top air exhaust in a upwards direction.

The embodiment depicted in FIG. 1 comprises in its bottom side tins and a tube heat condenser 103 with a cylindrical shape, which is coupled to a radial fan 104 in its top.

The cylindrical type condenser 103 can stand in a raised base 101 to allow a proper and homogeneous distribution of the air flow that crosses the condenser. In that way, any component of the system blocks the air flow in its way to the suction port of the radial fan.

The raised position of the condenser with respect the compressor base allows a water tank 114 to be located in conjunction with the compressor to retain the moisture condensation, and the implementation of a noise proof case 113 wrapped around the compressor, which will function as a barrier to block the vibrations and noise released by the compressor surface.

In its upper side, the embodiment of FIG. 1 comprises a cylindrical evaporator 108 placed over a circular base 107 which has the structural function of supporting the electronic box 116 and the axial fan 109 that is located in the top side of the evaporator.

The electronic box 116 can have a generally conic shape that allows the homogeneous flow of the air stream from the evaporator 108 to the axial fan 109. In some embodiments the element 116 (which can contain the electronic box) is wider in a bottom section thereof than in the top section thereof. The conic shape of the electronic box creates a narrow channel that allows the increase of the air speed in the base of the evaporator avoiding low pressure zones and turbulences in the central zone of the base that could unbalance the flow distribution over the evaporator surface. In that way, the velocity profile of the air stream that crosses the evaporator tends to be homogeneous and the heat transfer process is optimum.

On the top side of the system an air diffuser is located over the axial fan to guide the air stream after its path through the evaporator. The air diffuser comprises two main elements; the first one is an external ring 110, that encloses the evaporator fan blades and has a sealing function, and the central diffuser part 112 that has the function of guide the air outlet stream in two main directions: lateral and upwards.

The circular design of the air distributor also allows an air flow in a 360° pattern which provides a better temperature distribution in the conditioned space. Additionally, the diffuser includes some angles in the external ring and central element that generate two main air outlet streams, favouring a quicker cooling effect better temperature distribution, low noise effects, and higher air flow rates.

Below the design of Heat exchangers is described.

The geometrical characteristics of the cylindrical heat exchangers that are described herein include different parameters like the number of rows, tubes per row, pipe diameters, fin pitch, tube pitch and the relative angle between fins and the pipes that comprise the refrigerant circuits in the heat exchangers.

Condenser

Figure 2:
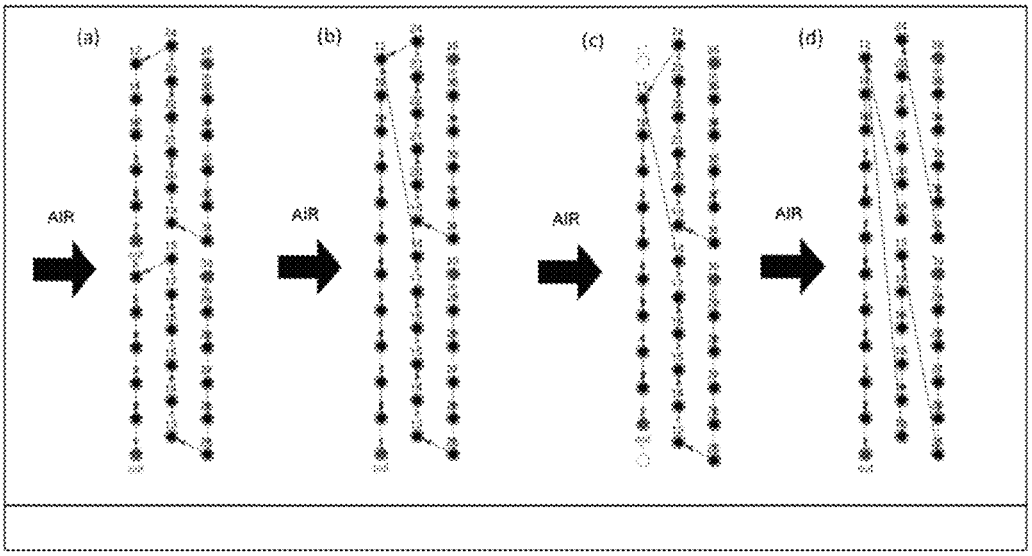
FIG. 2 depicts different embodiments of a condenser.

With regards to the circuiting design of the circular condenser, in some embodiments a three-row condenser with 2 passes in the two inner rows and one common pass in the external row is provided. Geometry of the connections can be designed to allow the proper distribution of the refrigerant, minimising the pressure drop in the refrigerant circuits. FIG. 2 depicts different embodiments of a condenser.

The number of pipes could be 8 or 12 per row, depending on the required capacity in the system. The length of the pipes can be selected in accordance with the required capacity in the AC unit. The flow arrangement for the fluids flow is in accordance with some embodiments a cross-flow path.

Pipe diameters in the condenser is in accordance with one embodiment between 5 to 6 mm to minimize the refrigerant charge of the system. The fin pitch can be defined taking into account the whole pressure drop on the air circuit and the flow rate driven by the condenser fan. The fin pitch can be fixed between 1.2 to 1.5 mm, and the total air flow rate in the condenser can be around 550-600 m3/h.

The tube pitch can be around 14 mm, to allow a homogeneous velocity profile in the total frontal area of the heat exchanger, which in turn can be on average around 1.4 m/s.

FIG. 2 shows the lateral cross section of a standard "U" pattern in a 12 tubes per row configuration FIG. 2*a*, and an embodiment which uses a 2 phases in the two inner rows and one common pass in the outer row in a 12 tubes per row configuration FIG. 2*b*. Additional embodiments are shown in FIG. 2*c* and FIG. 2*d*, for 12 tubes per row configuration. Similar circuiting design can be arranged in 8 tubes per row condensers.

The arrangements depicted in FIGS. 2*b*, 2*c*, and 2*d* generate on the one hand an additional pressure drop in the last row of the condenser, because of the merge of the two refrigerant streams coming from the two inner circuits.

That additional pressure drop is in turn produced by the increase of the refrigerant flow rate in a constant pipe section, since the diameter of the pipes is the same for the three rows and the refrigerant flow rate entering in the third row is the total flow rate driven by compressor.

In turn, the extra pressure drop created in the external row also produces a temperature decrease in the condensed refrigerant that is coming from the previous rows. That temperature drop helps to decrease the bulk temperature of the refrigerant that has previously reached the saturation conditions, increasing the subcooling effect over the liquid refrigerant accumulated in the last part of condenser.

As most of the refrigerant has reached the saturation, the extra pressure drop does not represent an excessive disadvantage in terms of the total power consumption of the compressor, but in turn it provides a capacity increase because the larger evaporation enthalpy reached in the evaporator.

Figure 3:
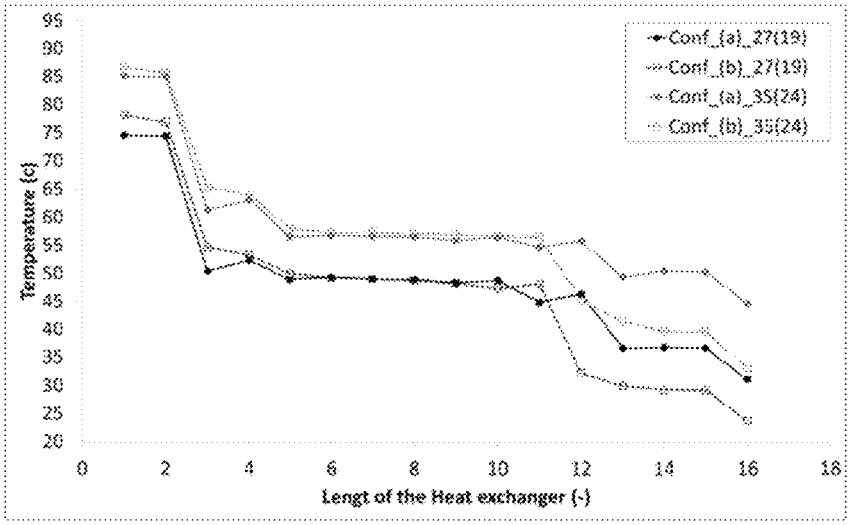
FIG. 3 shows an example of the temperature profile of configurations in accordance with FIG. 2*a* and FIG. 2*b*.

FIG. 3 shows an example of the temperature profile of configurations in accordance with FIG. 2*a* and FIG. 2*b*. In FIG. 3, two different temperature conditions were tested. As can be seen from FIG. 3, the saturation temperatures reached in with configurations of FIG. 2*a* and FIG. 2*b* are exactly the same, but the refrigerant outlet temperature is between 23 and 25K lower in the case of the geometry in accordance with FIG. 2*b*.

As the condensing temperature and pressure were kept constant in both configurations, the power consumption of the compressor was not affected, but as the subcooling degree was higher in configuration of FIG. 2*b*, the cooling capacity and Energy Efficiency Ratio (EER) of the system increased about 6% in the working condition 27(19) and about 9% in the condition 35(24).

Aeraulic Improvement of the Condenser Configuration

In the heat exchanger configurations described above, the air flow that crosses the condenser will normally tend to keep a rotational motion in the fan's rotational direction, generating an air whirl just below the suction port of the radial fan.

In accordance with one embodiment the spinning effect created by the fan over the air flow is taken into account, and suggests an alternative solution to reduce the negative effect over the pressure drop and noise created because of the change in the air flow direction due to the of the radial geometry of the fins in a standard cylindrical condenser.

A tilting angle between fins and copper tubes can be provided to create a straight-flow channel that connects the perimeter of the condenser to the suction port of the radial fan, to minimize the pressure drop effect generated by the change in the air flow direction when the air is accessing to the inner space of condenser.

Figure 4:
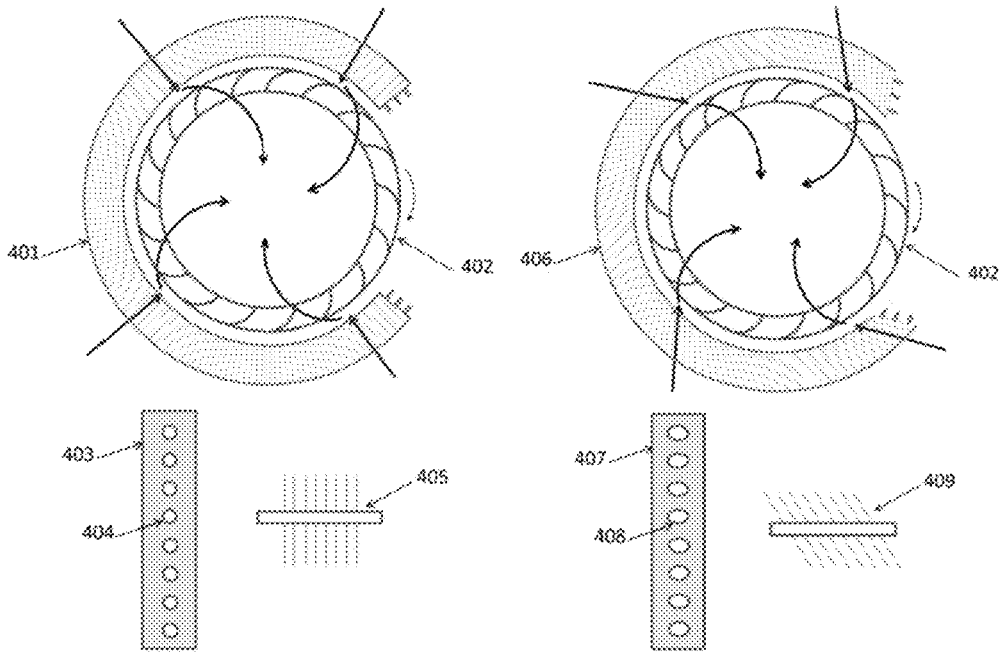
FIG. 4 shows a top view of the air path created in a cylindrical condenser.

FIG. 4 shows a top view of the air path created in a cylindrical condenser, first with a radial distribution in the condenser fins (left), and then including an alternative configuration with an entry angle in the fins arrangement (right). In both cases, a radial fan working in a clockwise direction is located in the top side of both condensers.

In FIG. 4-left, 401 represents a cylindrical condenser with a fins arrangement in radial distribution, 402 is a radial fan, 403 is a lateral view of the condenser fins, 404 represents the circular shape of the holes stamped on the condenser fins, 405 represents a top view of the relative position between tubes and fins before bending the heat exchanger.

In FIG. 4-right, 406 represents a cylindrical condenser with an entry angle in the fins arrangement, 407 represents a lateral view of the condenser fins, 408 represents the elliptical shape of the holes stamped on the condenser fins, 409 represents a top view of the relative angle between tubes and fins in the alternative configuration before bending the condenser.

An alternative embodiment can include different fan geometries, not only the forward-curved blades shown in FIG. 4. In that sense also backward-inclined blades can be used, since that fan geometry can provide higher pressures, higher efficiency ratios, or even the fan layout can reach a more compact design for a certain flow rate.

Further, the geometry of the housing can include additional layers of noise proof materials like high density expandable polystyrene, fiber cotton, or polyurethane rubber to minimize the noise and vibrations.

Additionally, the design of the housing can be improved by adding elements inside of the fan housing to reduce the clearance between the fan and the housing, and in turn avoid undesired airflow leaks by providing a sealing functionality and thus improving the system performance.

Figure 5:
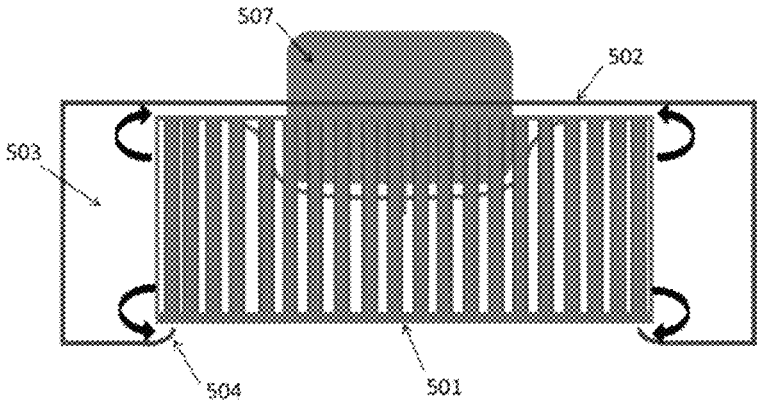
FIGS. 5 and 6 show radial fan housings.

FIG. 5 shows an embodiment of a radial fan housing, in which the air flow leaks affect the whole system performance. In FIG. 5, 501 represents a radial fan, 502 is a fan housing, 503 represents a discharge channel inside of the fan volute, 504 is a suction port of the radial fan, 507 is a fan motor.

Figure 6:
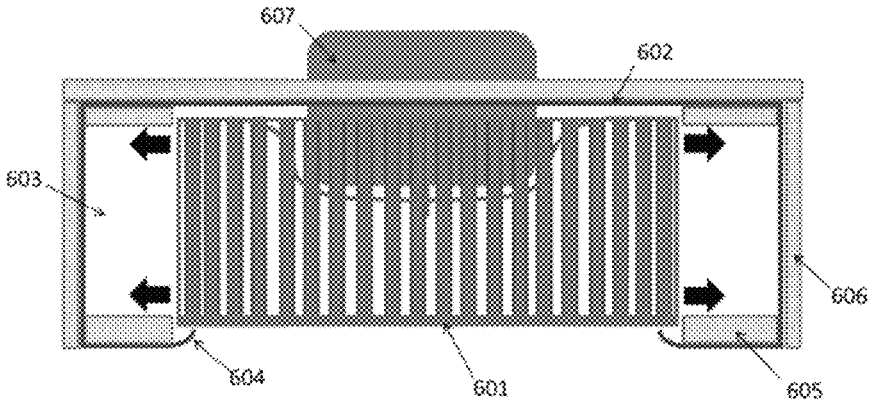

FIG. 6 shows an alternative embodiment of the radial fan housing, in which are included some sealing elements into the geometry, and a noise proof insulation material around the fan housing. In FIG. 6, 601 represents a radial fan, 602 is a fan housing, 603 is a discharge channel inside of the fan volute, 604 is a suction port of the radial fan, 605 are sealing elements in the housing made of an elastic material such as polystyrene or plastic, 606 is the noise proof envelope around the fan housing, and 607 is the motor fan. The sealing elements are located in the fan housing. The sealing elements can be located at the corners of the fan housing.

The sealing elements provide the advantage of minimising the internal air leakages, without the need of improving the manufacturing tolerances in the current systems, while maintaining low manufacturing cost.

Evaporator

With regards to the evaporator circuiting design, a two-row evaporator with the possibility to use 2 or 3 passes can be provided. The geometry has been designed to reduce the pressure drop inside of the refrigerant circuits, allowing a proper distribution of the refrigerant through the heat exchanger circuiting.

Reaching a homogeneous refrigerant distribution into multiple circuits of an evaporator is particularly difficult because the refrigerant that comes from the expansion device is in a 2-phase flow. Therefore, implementation of more than 2 circuits in an evaporator could sometimes result in a poor distribution of the liquid and vapour phases along the circuits.

In accordance with some embodiments a distributor element is provided between the expansion device and the evaporator inlet. The distributor is adapted to split the refrigerant flow in three different branches. This can act to equalize the pressure drop in all of them and then guiding individually the separated refrigerant flows to each pass of the evaporator. The distributor can be located initially in a vertical position to allow the liquid refrigerant drops by gravity, and then the branches of the distributor can be redirected in to the evaporator inlet ports.

The number of pipes for the evaporator can be 8-12 per row, depending on the required capacity in the AC unit. The length of the pipes can be in accordance with the required capacity in the AC unit. The flow arrangement for the fluids flow is a cross-flow path.

The diameter of the pipes in the evaporator can be between 6 to 7 mm to reduce the pressure drop in the refrigerant circuit. The fin pitch can be defined taking into account the whole pressure drop on the air circuit and the flow rate driven by the evaporator fan. The fin pitch can be fixed between 1.2 to 1.5 mm, and the total air flow rate in the evaporator can be around 530 m3/h.

The tube pitch can be between 14 to 17 mm to allow a homogeneous velocity profile in the frontal area of the heat exchanger, which in turn can be on average around 1.1 m/s.

Figure 7:
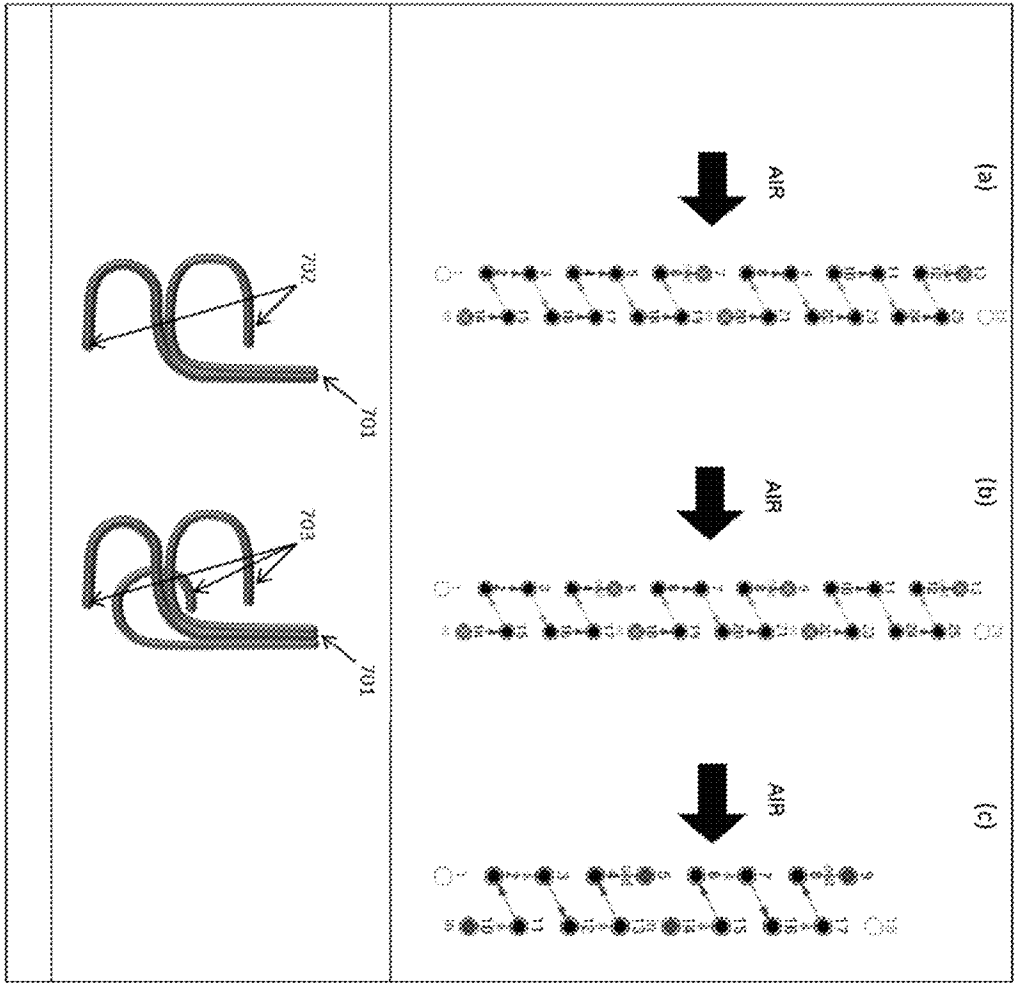
FIG. 7 shows the lateral cross section of an evaporator.

FIG. 7 shows the lateral cross section of an evaporator with a "Z" pattern connection with two passes in a 12 tubes per row configuration in FIG. 7*a*, and an improved embodiment which uses a 3 phases in a 12 tubes configuration in FIG. 7*b*. An 8 tubes circuiting design with two passes is shown in FIG. 7*c*. FIG. 7 also shows a proposed geometry of the distributor element for 2 and 3 passes evaporator. In FIG. 7, 701 represents a refrigerant inlet port from an expansion device, 702 are distributor branches for a two passes configuration, 703 are distributor branches for a three passes configuration. The design of the distributor elements acts to split the refrigerant before it enters the evaporator.

Figure 8:
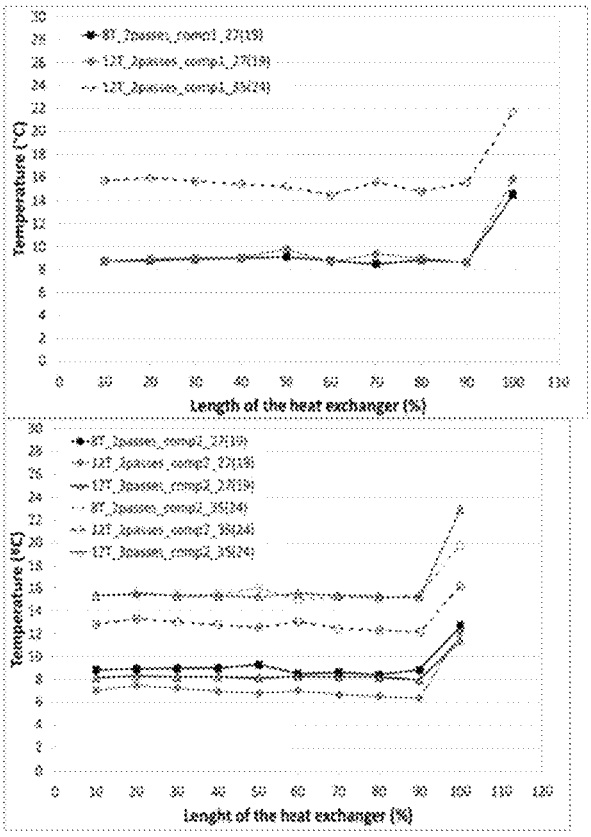
FIG. 8 shows a comparative analysis of temperature profiles.

FIG. 8 shows a comparative analysis of the temperature profiles obtained experimentally from configurations (a), (b) and (c) in FIG. 7. In FIG. 8, two different temperature conditions were tested 27(19) and 35(24). Additionally, two different sizes of compressors were also used in the comparison, comp1 provides about 2.5 kW of cooling capacity and comp2 provides about 3.4 kW of cooling capacity. Compressors selected for the analysis are the standard sizes of compressors used for portable AC applications.

From the standpoint of the refrigeration cycle, the configuration using 8 tubes per row configuration (c), provides a high performance in terms of pressure drop; balanced distribution of the refrigerant in both passes and cooling capacity. From the air circuit side, the configuration using 8 pipes per row generate higher pressure drops since the air intake section decreases in comparison to the 12 tubes arrangement. To minimize the pressure drop in the air side, a larger tube separation is required in the 8 tubes per row solution.

In FIG. 8 the configuration (c) with 8 tubes per row presents higher evaporating temperatures in comparison with the configurations using 12 tubes. Higher evaporation temperatures mean higher suction pressures and less power consumption. Additionally, the sensible heat ratio is higher, which means that a higher percentage of the cooling capacity provided by the system is used to decrease the air temperature more than condensate the moisture of the air.

FIG. 8 shows also that the use of a 3 passes configuration in a 12 tubes evaporator, configuration (b), provides also a better performance in comparison to the configuration using 2 passes in a 12 tube arrangement evaporator (a).

The election of a configuration of 8-tubes & 2-passes or 12-tubes & 3 passes will depend on the evaporator fan selection and the pressure drops achieved in the air circuit.

Aeraulic Improvement of the Evaporator Configuration

From the aeraulics standpoint, the cylindrical evaporator can include the use of a radial fan coupled in the top side of the heat exchanger. System also includes an internal conic body that has the structural function of supporting the radial fan and contains the electronic and control systems of the unit.

Additionally the conic box has also the function of guide the air stream in its way to the axial fan inlet. The conic shape of the electronic box creates a narrow channel that allows the increase of the air speed in the base of the evaporator avoiding low pressure zones and turbulences in the central zone of the base, which could unbalance the flow distribution over the evaporator surface. In that way, the velocity profile of the air stream that crosses the evaporator tends to be homogeneous and the heat transfer process is improved.

Figure 9:
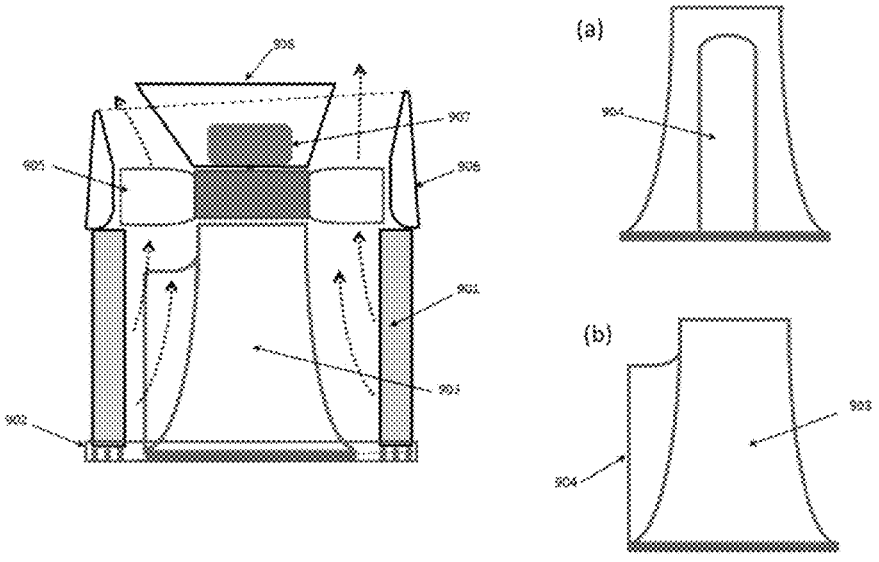
FIG. 9 shows an embodiment of the evaporator and other components, including a conic electronic box.

FIG. 9 shows an embodiment of the evaporator and other components, including the conic electronic box. In FIG. 9, 901 represents a cylindrical evaporator, 902 is an evaporator base, 903 is an electronic box with a conic shape, 904 is an access door to the electronic box, 905 is a radial fan, 906 and 908 are air diffuser elements in the top side of the system, 907 is a motor fan of the evaporator. FIG. 9*a* and FIG. 9*b* show frontal and lateral views of the electronic box and the access door to the electronic components.

With regards the air flow pattern that crosses the evaporator the pressure drop and noise generated by the radial fins is reduced by an arrangement that comprises a cylindrical evaporator. The solution proposed employs a tilting angle between fins and copper tubes. This method helps to create a straight-flow channel that connects the perimeter of the condenser to the suction port of the radial fan, which reduces the pressure drop effect generated by the change in the air flow direction when the air stream is accessing to the inner space of evaporator.

Figure 10:
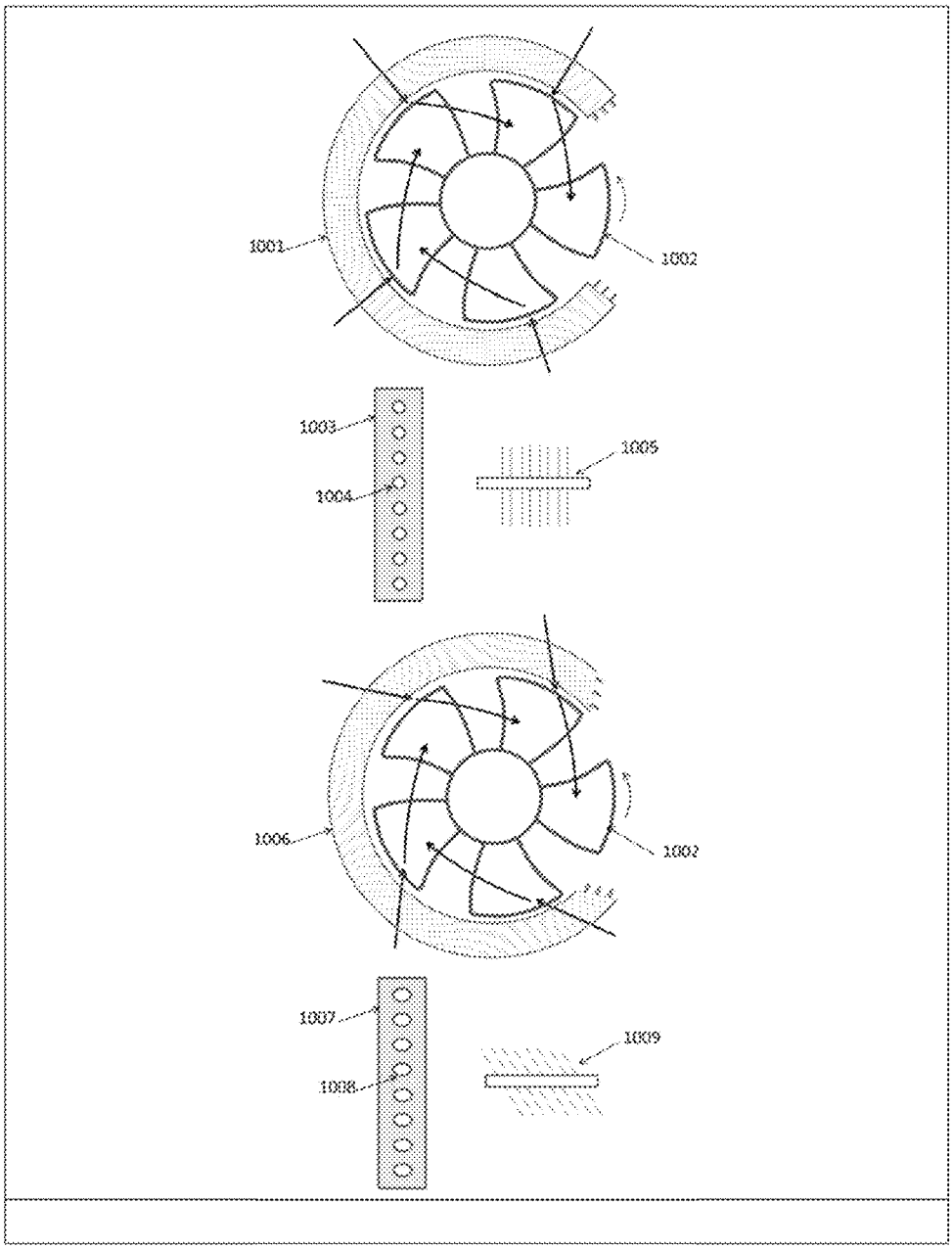
FIG. 10 shows a top view of the air path created in a cylindrical evaporator.

FIG. 10 shows a top view of the air path created in a cylindrical evaporator, first with a radial distribution in the evaporator fins (left), and then including an alternative configuration with an entry angle in the fins arrangement (right). In both cases, an axial fan working anticlockwise is located in the top side of both alternatives.

In FIG. 10-left, 1001 represents a cylindrical evaporator with a fins arrangement in radial distribution, 1002 is the axial fan, 1003 is a lateral view of the evaporator fins, 1004 represents the circular shape of the holes stamped on the evaporator fins, 1005 represents the top view of the relative position between tubes and fins before bending the heat exchanger.

In FIG. 10-right, 1006 represents a cylindrical evaporator with a modified fins arrangement which include an air entry-angle between fins and tubes, 1007 represents the lateral view of the evaporator fins. 1008 represents the elliptical shape of the holes stamped on the evaporator fins, 1009 represents the top view of the relative angle between tubes and fins before bending the evaporator.

Air Diffuser Element

In accordance with one embodiment an air diffuser element is located in the top side of the AC unit. The diffuser is located above the evaporator and its axial fan.

The diffuser is adapted to guide the air stream after its path through the evaporator. The air diffuser comprises two main components; the first one is an external ring, which encloses the fan blades working as a sealing element; the second component is the diffuser core part that has the function of guide the air outlet stream in a rotational spire with two main directions.

In that sense, the circular design of the diffuser allows an air flow in a 360° pattern which provides a better temperature distribution in the conditioned space and favouring a quicker cooling effect.

The design of the diffuser includes a lateral angle in its external ring and some curvatures in its core element which generate two main air outlet streams, to upwards and to the frontal part of the unit.

The diffuser design allows the displacement of higher air flow rates, improving the cooling capacity of the system, but also creating an air vortex pattern that improves the air movement into the conditioned space, and providing a better temperature distribution.

Figure 11:
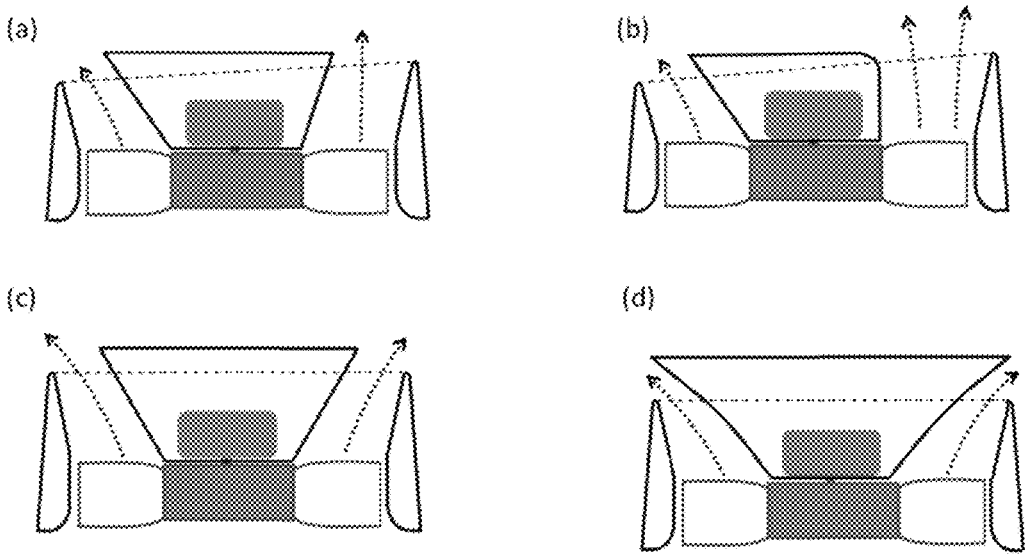
FIG. 11 illustrates different solutions for an air diffuser geometry.

FIG. 11 shows different solutions for the air diffuser geometry. The rotational movement of the flow allows a 360 degrees outlet favouring a homogeneous temperature distribution in the conditioned space and higher comfort for the user.

The technical solutions described herein support improved performance of a portable air conditioner using cylindrical heat exchangers include the thermal and aeraulic aspects that affect the system optimisation. In particular an improved air-flow within the air-conditioner can be obtained.

The combination of the larger frontal areas offered by the use of cylindrical heat exchangers and their proper circuiting design will allow the increase of the cooling capacity of the system, and the minimisation of the electric power consumption, which in turn offer higher energy efficiency ratios.

The design of the air exhaust distributor for the evaporator represents a valuable alternative to enhance the air flow rate, improving the cooling effect and the air temperature distribution in the conditioned space, where the AC system is emplaced.

The use of a radial fan housing, which includes sealing elements in its internal structure adapted to reduce the clearance distance between the fan and the housing, and also having the function of avoiding undesired airflow leaks. The design of the fan housing also includes the use of a noise proof envelope to minimise the noise and vibrations generated in its normal operation.

The use of a conic element that supports the evaporator fan and that is adapted to guide the evaporator air flow provides a homogeneous air distribution along the heat exchanger surface. In addition to the air flow and structural functions, the conic clement has been designed to work as an electronic and control box.

The use of an air diffuser element placed in the top side of the evaporator adapted to guide the air stream after its path through the heat exchanger provides further improvement. The circular design of the diffuser and the angles in their internal and external rings allow an air flow in a 360° pattern which provides a better temperature distribution in the conditioned space and improves the cooling effect provided by the system.

The invention claimed is:

1. A portable air-conditioner comprising:

a housing;

a compressor located inside the housing;

a three-row cylindrical condenser located inside the housing;

an evaporator located inside the housing;

an axial fan located inside the housing;

an airflow path located inside the housing and extending from the evaporator to the axial fan;

an element located in the airflow path between the evaporator and the axial fan;

a cool air outlet at the end of the airflow path; and a warm air outlet, wherein the three-row cylindrical condenser is configured to include two passes of a refrigerant stream in two inner rows of the three rows and one common pass of the refrigerant stream in an outer row of the three rows.

2. The portable air-conditioner according to claim 1, wherein the housing is configured to rest on a horizontal surface during operation, and the element is wider at a lower section thereof than in an upper section thereof.

3. The portable air-conditioner according to claim 1, wherein the element is conical.

4. The portable air-conditioner according to claim 1, wherein the element houses an electronic box.

5. The portable air-conditioner according to claim 1, wherein the housing is configured to rest on a horizontal surface during operation with the cool air outlet located at a top end of the housing, and the cool air outlet comprises an air diffuser having a first element and a second element that is separate from the first element, the air diffuser being configured to provide an air outflow in both an upwards direction and a lateral direction.

6. The portable air-conditioner according to claim 5, wherein the first element is ring shaped and encloses an outer perimeter of the axial fan.

7. The portable air-conditioner according to claim 6, wherein the second element comprises an inverted conical surface located radially within at least a portion of the first element.

8. The portable air-conditioner according to claim 7, wherein the second element is configured to direct all of the upward air-stream in a direction deviating from the direction of the upward air-stream.

9. The portable air-conditioner according to claim 1, wherein the condenser has 8 or 12 pipes per row.

10. The portable air-conditioner according to claim 9, wherein the pipes have a diameter between 5-6 mm.

11. The portable air-conditioner according to claim 1, wherein the condenser comprises fins having circular or elliptical holes.

12. The portable air-conditioner according to claim 1, wherein the portable air-conditioner comprises a condenser radial fan, the radial fan comprising a housing having sealing elements provided inside the housing.

13. The portable air-conditioner according to claim 12, wherein the sealing elements are configured to reduce a clearance distance between the radial fan and the housing.

14. A portable air-conditioner comprising:

a housing;

a compressor located inside the housing;

a three-row cylindrical condenser located inside the housing;

an evaporator located inside the housing;

a cool air outlet; and a warm air outlet wherein the housing is configured to rest on a horizontal surface during operation with the cool air outlet at a top end of the housing, and the cool air outlet comprises an air diffuser having a first element and a second element that is separate from the first element, the air diffuser being configured to provide an air outflow in both an upwards direction and a lateral direction; and wherein the three-row cylindrical condenser is configured to include two passes of a refrigerant stream in two inner rows of the three rows and one common pass of the refrigerant stream in an outer row of the three rows.

15. The portable air-conditioner according to claim 14 wherein the first element is ring shaped and encloses an outside of a fan configured to draw air across the evaporator.

16. The portable air-conditioner according to claim 14, wherein the second element is adapted to allow an upward air stream and to direct at some of the upward air-stream in direction deviating from the upward direction of the upward air-stream.

17. The portable air-conditioner according to claim 16, wherein the second element is configured to direct all of the upward air-stream in direction deviating from the direction of the upward air-stream.

18. A portable air-conditioner comprising:

a housing;

a compressor located inside the housing;

a three row cylindrical condenser located inside the housing;

an evaporator located inside the housing;

a cool air outlet;

an element located in the housing between the evaporator and the cool air outlet; and a warm air outlet, wherein the three-row cylindrical condenser is configured to include two passes of a refrigerant stream in two inner rows of the three rows and one common pass of the refrigerant stream in an outer row of the three rows.

19. The portable air-conditioner according to claim 18, wherein the condenser has 8 or 12 pipes per row.

20. The portable air-conditioner according to claim 19, wherein the pipes have a diameter between 5-6 mm.

21. The portable air-conditioner according to claim 18, wherein the condenser comprises fins having circular or elliptical holes.

* * * * *